United States Patent [19]

Yanagisawa et al.

[11] Patent Number: 5,051,077

[45] Date of Patent: Sep. 24, 1991

[54] SCREW COMPRESSOR

[75] Inventors: Kiyoshi Yanagisawa; Mitsuru Maeda; Yoshiyuki Maruta; Toshitsugu Sase, all of Kanagawa, Japan

[73] Assignee: Ebara Corporation, Tokyo, Japan

[21] Appl. No.: 446,292

[22] Filed: Dec. 5, 1989

[30] Foreign Application Priority Data

Dec. 5, 1988 [JP] Japan ..... 63-306120

[51] Int. Cl.[5] ..... F04C 18/08; F04C 2/08

[52] U.S. Cl. ..... 418/201.1; 418/197

[58] Field of Search ..... 418/197, 181, 201.1, 418/201.2, 201.3

[56] References Cited

U.S. PATENT DOCUMENTS

| | | | |
|---|---|---|---|
| 2,480,818 | 8/1949 | Whitefield | 418/201.1 |
| 4,018,549 | 4/1977 | Segerström | 418/201.1 |
| 4,643,655 | 2/1987 | Uthoff | 418/201.1 |

FOREIGN PATENT DOCUMENTS

| | | | |
|---|---|---|---|
| 110889 | 7/1983 | Japan | 418/201.1 |
| 20687 | 1/1987 | Japan | 418/201.1 |
| 63-86390 | 6/1988 | Japan . | |

OTHER PUBLICATIONS

"Development of the Eaton Supercharger", Loren H. Uthoff et al., SAE Technical Paper Series 870355, 1987.

"Noise Attenuation in Roots Blower", Ohtani et al., Japanese Machinery Association Papers, vol. 46, No. 407, Jul. 1980.

*Primary Examiner*—Leonard E. Smith

*Assistant Examiner*—David L. Cavanaugh

*Attorney, Agent, or Firm*—Wenderoth, Lind & Ponack

[57] ABSTRACT

The present invention is drawn to a screw compressor having a wide operating range with respect to flow rate and pressure ratio, wherein a discharge opening portion of a casing is provided with a generally tapered notch portion so that compressed gas is gradually discharged from a certain fixed point where a volume ratio of one groove defined by rotors and the casing is smaller than an inherent built-in volume ratio. Since the present invention is arranged in the above-mentioned manner, the flow of the gas at the discharge opening portion is reduced by the notch portion which is readily formed. Thereby the variation range of the pressure (the amplitude of pulsation of the pressure) is decreased and the noise level is lowered. Further, a loss of pressure resulting from the rapid flow of the gas is restricted to thereby widen a range of preferable performance of the compressor.

8 Claims, 9 Drawing Sheets

8A
C
B
A
9
C'

C
B
8B
A
9
C'

C
B
8C
A
9
C'

B
C
8D
A
9
C'

B
8E
A
9
C'

C
B
8
A
9
C'

SCREW COMPRESSOR

BACKGROUND OF THE INVENTION

The present invention relates to a screw compressor, and more particularly to a screw compressor for delivering or feeding gas such as air in a compressed condition.

As shown in FIG. 1, in a typical conventional screw compressor, gas sucked from a suction opening portion 1 is confined in a groove-like space defined by a pair of rotors 2, 2' and a casing 3 and when the rotation of the rotors 2, 2' is progressively advanced, the groove-like space is reduced to a volume which corresponds to a built-in volume ratio of the screw compressor. The gas is then compressed to a ratio corresponding to the built-in volume ratio and the compressed gas is then discharged from a discharge opening portion 4 of the casing.

In the conventional screw compressor, however, when the pressure at the discharge opening is greater than the pressure of the compressed gas within the rotor grooves (under-compression), a rapid backflow of the gas into the grooves results, while when the pressure at the discharge opening is smaller than the pressure of the compressed gas within the rotor grooves (overcompression), a strong discharge of gas into the discharge opening is caused. These rapid changes in flow rate during the discharging operation cause a wide pressure variation at the discharge opening portion. The casing of the compressor is thus directly vibrated owing to the variation in the pressure of the discharged gas, so that noise is generated by the casing. The variation in the pressure also causes vibration in the rotors of the compressor, and the vibrating force from the rotors is then transmitted to the casing via bearings. Further, noise is also generated by the gear and bearing portions due to the vibration of the rotors.

On the other hand, the noise on the discharge side of the screw compressor is directly transmitted to the suction side thereof through a solid member, i.e. the casing. Further, the vibration on the discharge side is propagated to the suction side of the casing through the gas leaking through the gaps defined between the two rotors and between the rotors and the casing. The present inventors recognize through their investigation that the noise at the suction opening portion 1 of the casing is mainly caused by the latter reasons.

Tolerances of the gaps between the two rotors and between the rotors and the casing are determined in consideration of production accuracy (allowances in machining and assembling processes), heat deformation, torsional deformation of the rotors due to axial torque and the like. The smaller the tolerance values of the gaps is, the lower the transmission of the pressure variation from the discharge side to the suction side through the leakage of the gas. However, there are actually restrictions in accuracy due to the reasons stated above so that tolerances cannot be achieved at less than a critical value.

In general, in this type of compressor, the pressure ratio is essentially high and the operating range is normally limited to a high range. The uppermost efficiency point is designed as a target operating point. If a compressor is operated within a range outside of the designed operating point, the reduction in efficiency of the compressor and an increase in the above-described noise caused by vibration are remarkable. On the contrary, a known compressor employs a mechanism referred to as a "slide vane" which acts to increase the operating range. The structure is, however, complicated, and accordingly, this type of compressor is not an essential measure for solving the problem previously described.

Also, as a method for attenuating the pressure variation in a screw compressor, it has been proposed to provide a narrow or fixed size flow passage communicating between a space of a groove defined by the rotor and the casing and a discharge opening or suction opening of the compressor. In this type of compressor, however, the attenuation of the pressure variation could effectively be made within a targeted operating range without substantially decreasing the efficiency of the compressor.

SUMMARY OF THE INVENTION

An object of the present invention is to provide a screw compressor having a simplified structure, and by which structure a high degree of efficiency and noise reduction over a wide operating range can be realized.

According to the present invention, in a screw compressor having a wide operating range with respect to its flow rate and pressure ratio, a discharge opening portion of a casing is provided with a generally tapered notch portion so that compressed gas may be gradually discharged from a certain fixed point B where a volume ratio of one groove defined by rotors and the casing is smaller than an inherent built-in volume ratio $V_{max}/VA$ of the groove.

It is preferable that this fixed point B be selected at a location where a later-mentioned volume ratio $\phi B/\phi A$ is set within 70%–90%.

It is also preferable that a forward edge of the tapered notch portion extend parallel to seal lines formed between the rotors and the casing.

The volume V of the tapered notch portion is preferably set to about 1%–6% of the suction volume $V_{max}$ of the one groove defined by the rotors and the casing.

Further, the volume V* of the notch portion is preferably set to about 1%–8% of the volume VA of the one groove when the gas starts to be discharged directly to the discharge opening without passing first through the notch portion.

Moreover, the volume V* of the notch portion is favorably set to about 5%–50% of the decreased amount of the volume (VB-VA) of the one groove, namely the decrease in volume between the point B where the gas starts to gradually be discharged via the notch portion and the point A where the gas starts to be discharged without passing through the notch portion.

In addition, it is favorable that two or more seal lines defined by the tops of the rotors and the inner surface of the casing be respectively provided on the male and female rotors.

In the screw compressor having the above-described structure, the gas in the groove-like space is gradually discharged through the generally tapered notch portion to the discharge opening portion and the flow rate of the gas is less rapid in comparison with a case where the notch portion is not provided. Accordingly, the variation range of the pressure (an amplitude of pulsation of the pressure) at the discharge opening portion caused by the discharged flow is decreased, the noise level is lowered, and further a loss of pressure owing to the rapid flow of the gas is reduced.

The above and other objects, features and advantages of the present invention will become more apparent from the following description when taken in conjunction with the accompanying drawings in which preferred embodiments of the present invention are shown by way of illustrative examples.

DETAILED DESCRIPTION OF THE PREFERRED EMBODIMENTS

Preferred embodiments of the present invention will be described hereinafter with reference to the drawings.

Figure 1:
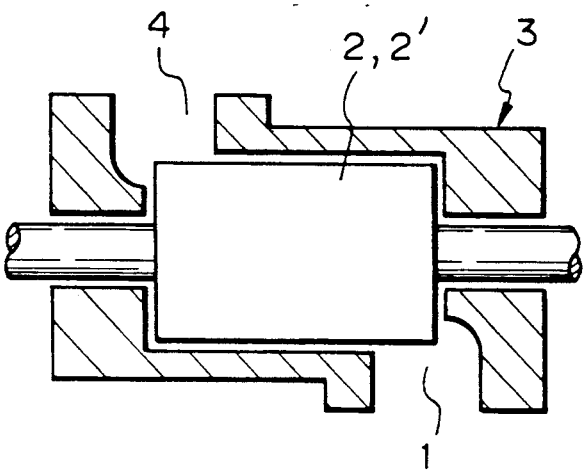
Fig. 1 PRIOR ART
FIG. 1 is a longitudinal cross-sectional view of a conventional compressor.
Figure 2:
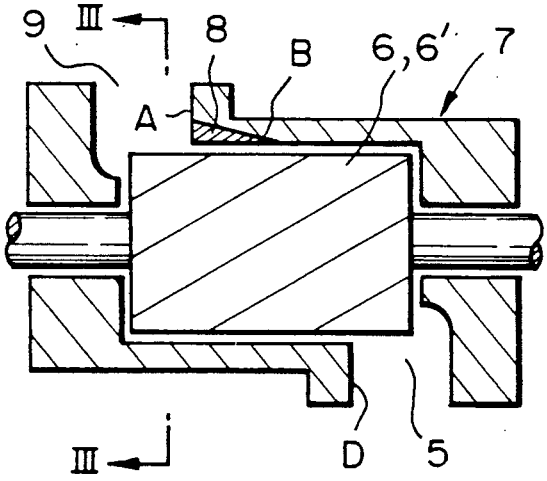
FIG. 2 is a longitudinal cross-sectional view of the present invention.
Figure 3:
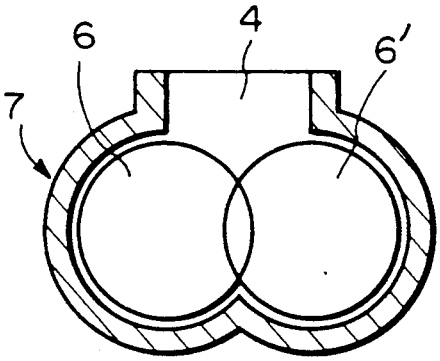
FIG. 3 is a cross-sectional view taken along the line III—III of FIG. 2.

FIGS. 2 and 3 illustrate a male rotor 6 and a female rotor 6' in a casing 7, with gaps interposed between both the rotors and between the casing and the rotors. Gas sucked through a suction opening portion 5 is confined in a groove-like space defined by the rotors 6, 6' and the casing 7, is compressed by rotation of the rotors 6, 6' and is then discharged from a discharge opening portion 9.

Figures 4A, 4B, 4C:
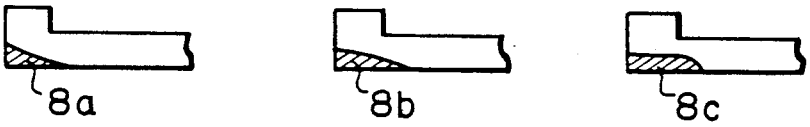
FIG. 4(*a*) to 4(*c*) are fragmentary longitudinal cross-sectional views respectively showing different notch portions.
Figures 5A, 5B, 5C, 5D, 5E, 5F:
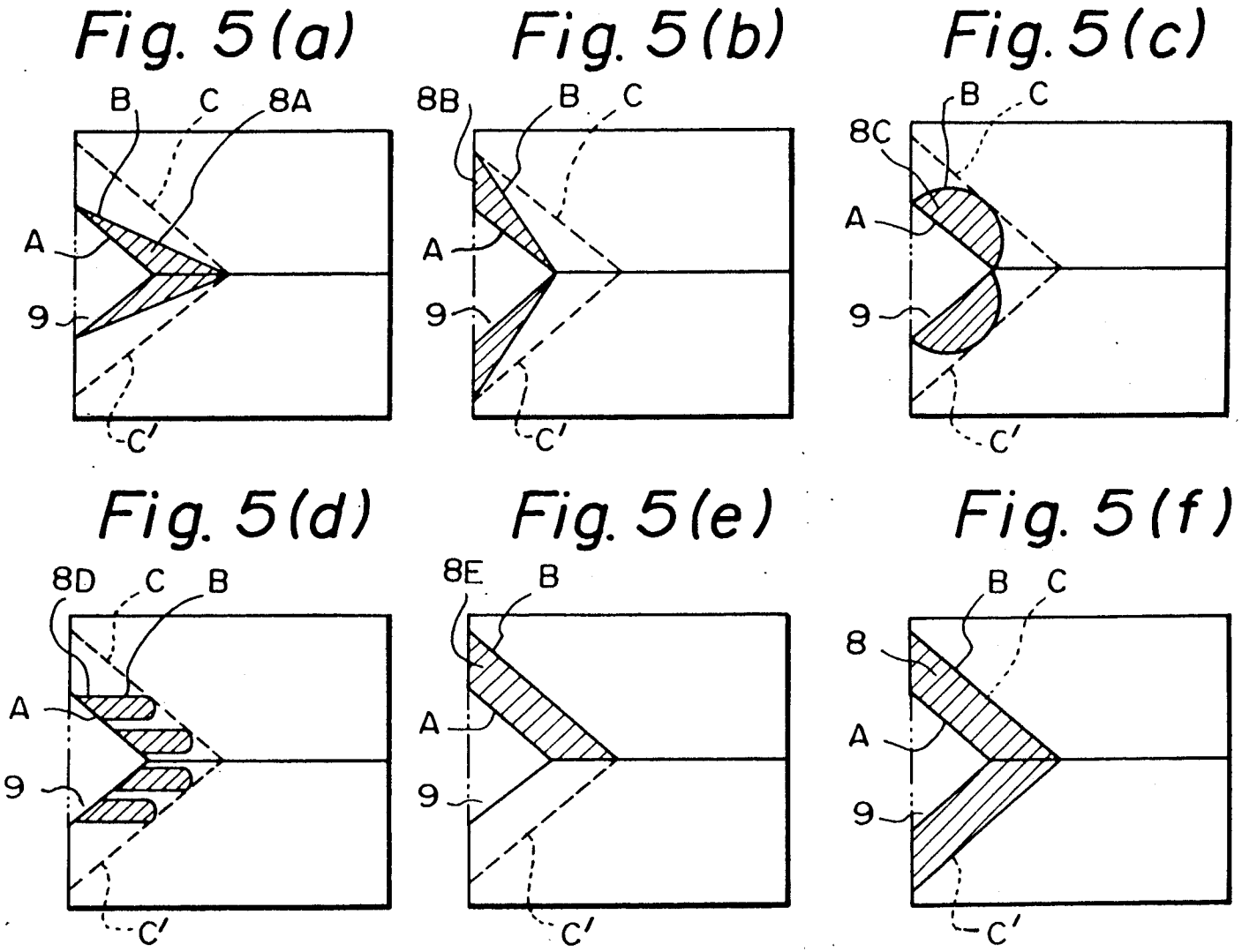
FIGS. 5(*a*) to 5(*f*) illustrate, respectively, different notch portions as viewed from the inner side of a casing.

A notch portion 8 having a generally tapered configuration is formed at the discharge opening portion 9, as shown with a shaded portion. It is to be noted that the shaded portion shows a portion of the casing to be cut out. As shown in FIGS. 4(*a*) to 4(*c*), this notch portion 8 having a generally tapered configuration may be a concave notch portion 8*a*, a convex notch portion 8*b* or a notch portion 8*c* which is curved at its end adjacent the suction opening portion 5. As viewed from the inner side of the casing 7, the discharge opening portion 9 has a V-shaped configuration such that the forward edge lines A of the notch portion may be parallel to seal lines C, C' formed between the rotors 6, 6' and the casing as shown in FIG. 5(*f*). Rearward edge lines B opposing the forward edge lines A of the notch portion 8 are arranged so as to be parallel to the edge lines A in the embodiment shown in that figure. The volume V* of the notch portion 8 is set to about 1%–6% of the suction volume $V_{max}$ of one groove, i.e. one of the groove-like spaces defined by the rotors 6, 6' and the casing 7. The various configurations of the notch portion 8 are shown in FIGS. 5(*a*) to 5(*d*), as viewed from the inner side of the casing 7. Referring to these drawings, there are shown a notch portion 8A having edge lines A and B whose forward ends coincide with each other (FIG. 5*a*), a notch portion 8B having edge lines A and B whose rear ends similarly coincide with each other (FIG. 5*b*), a notch portion 8C having arcuate rear edge lines B which are in contact with the seal lines C, C' and whose both ends coincide with those of the forward edge lines A (FIG. 5*c*), and notch portions 8D having the rear edge lines B which are divided into a plurality of separated curved lines [i.e., four in the embodiment shown in the FIG. 5(*d*)], all of which curved lines are in contact with the seal lines C, C' and both ends of each curved line coincide with the forward edge of lines A (FIG. 5*d*). As shown in FIG. 5(*e*), there is a notch portion 8*e* provided only on the side of the male rotor 6.

Figure 6:
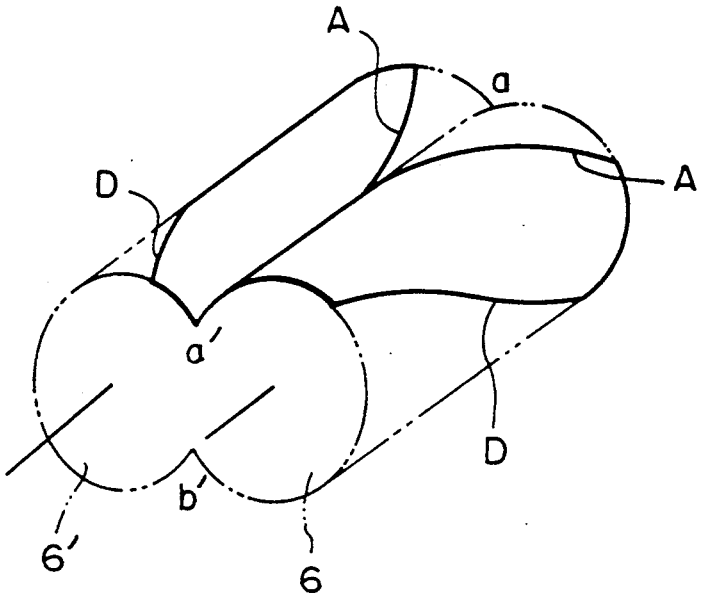
FIGS. 6 and 7 are a perspective view and a development diagram respectively indicating an inner surface of the casing.
Figure 7:
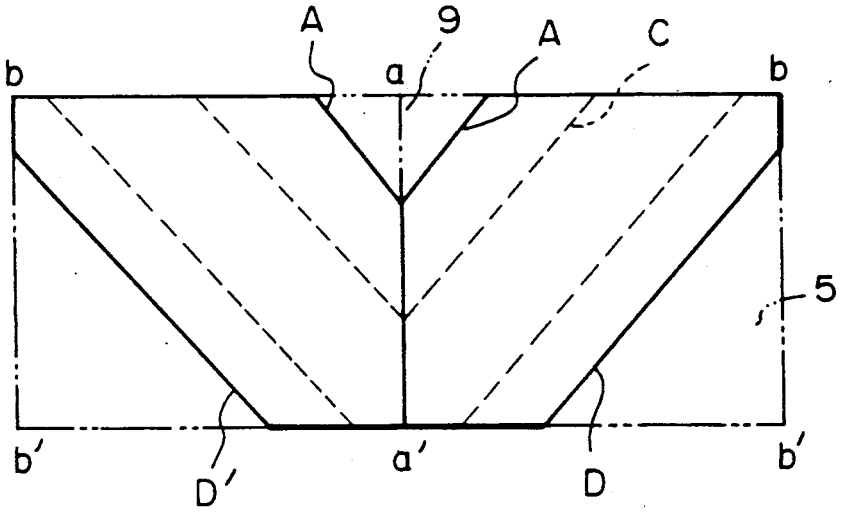

On the other hand, as shown in FIGS. 6 and 7, two seal lines C are formed between the tops of the rotors and the inner surface of the casing 7 with regard to each of the male rotor 6 and the female rotor 6'. The position and configuration of the rear edge line B of the notch portion is determined considering the following matter.

Figure 8:
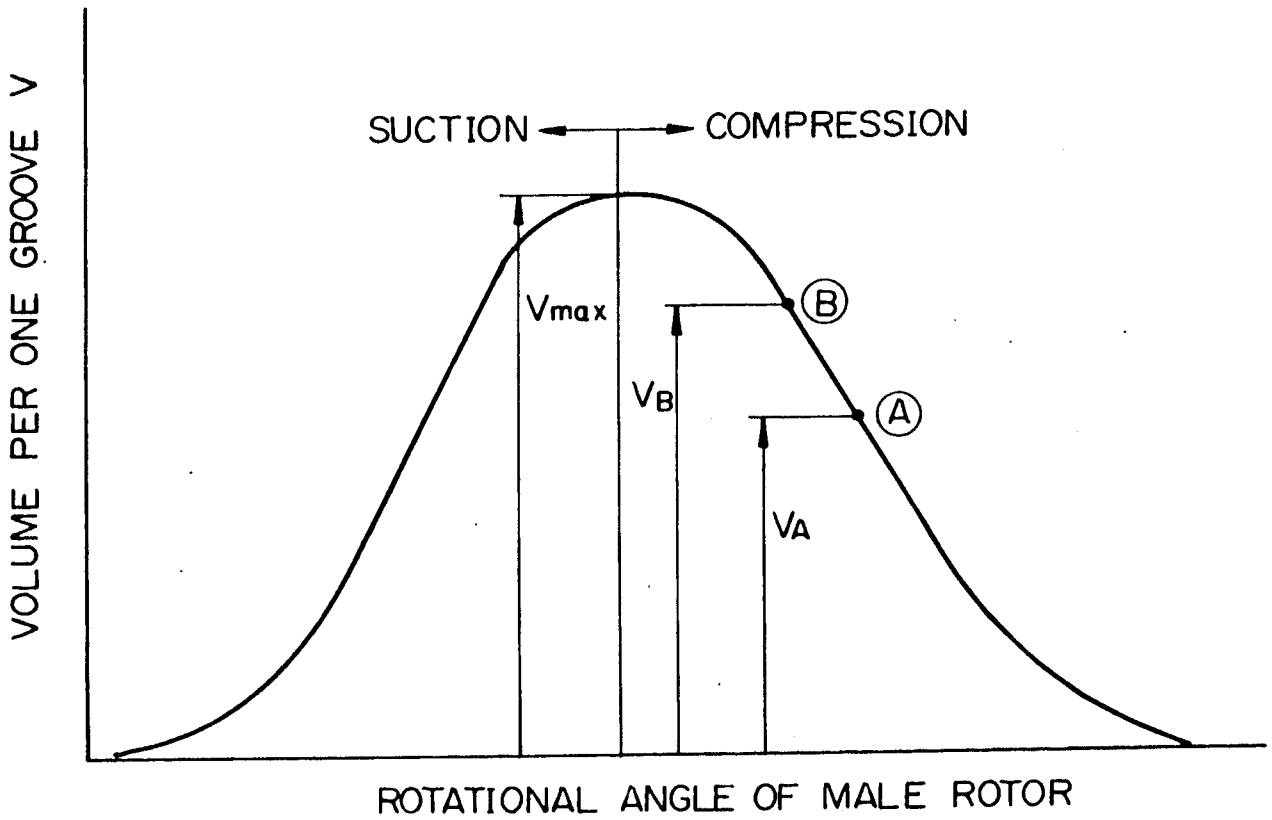
FIG. 8 is a graph illustrating a change in the volume of one groove during operation of a compressor.

A change in the volume V of one groove corresponding to the rotational angle of the male rotor 6 is shown in FIG. 8. The left half of the drawing designates a suction process and the right half of the same designates a compression process. The peak volume arises at a junction between both of the processes. The volume at the junction is the suction volume $V_{max}$ of the one groove. A discharge of a gas to the discharge opening portion 9 from a confined groove starts from the fixed point B at the rear edge lines B of the notch portion 8, and a complete discharge starts from the fixed point A at the forward edge lines A of the discharge opening 9, and the discharge is completed at a position a shown in FIG. 7.

Assuming that the volume ratio $\phi B$ at the fixed point B is $V_{max}/VB$ and the volume ratio $\phi A$ at the fixed point A is $V_{max}/VA$, the position of the fixed point B is determined so that the ratio $\phi B/\phi A$ is within a range of 70%–90% from the test results shown in FIGS. 14(*a*) and 14(*b*) described below.

A function of the notch portion 8 will be specifically explained here. Gas in the groove-like space is gradually discharged through the tapered notch portion 8 to the discharge opening portion 9 (or gas contra-flows from the discharge opening portion 9 to the groove-like space), whereby the flow of the gas is less rapid in comparison with a case in which the notch portion 8 is not provided. Therefore, a variation range of the pressure (the amplitude of pulsation of the pressure) in the discharge opening portion 9 which results from the discharge flow is decreased and the noise level is lowered. Also, a loss of pressure caused by a rapid flow is reduced to thereby widen the preferable range of performance of the compressor.

Propagation of the variation in the pressure from the discharge side to the suction side is decreased by providing at least two seal lines C, so that the noise level at the suction opening portion 9 is lowered.

Next, experimental results of an embodiment in accordance with the present invention will be described with reference to FIGS. 9 to 13.

If the discharge pressure during actual operation, i.e. operating pressure, is referred to as P2, and the suction pressure during actual operation is referred to as P1, the pressure ratio $\pi$ is P2/P1, and the built-in pressure ratio $\pi i$ is $(Vi)^n$ (n:politropic index). It is readily understood that the compression is excessive when $\pi < \pi i$ and the compression is insufficient when $\pi > \pi i$.

Figure 9A:
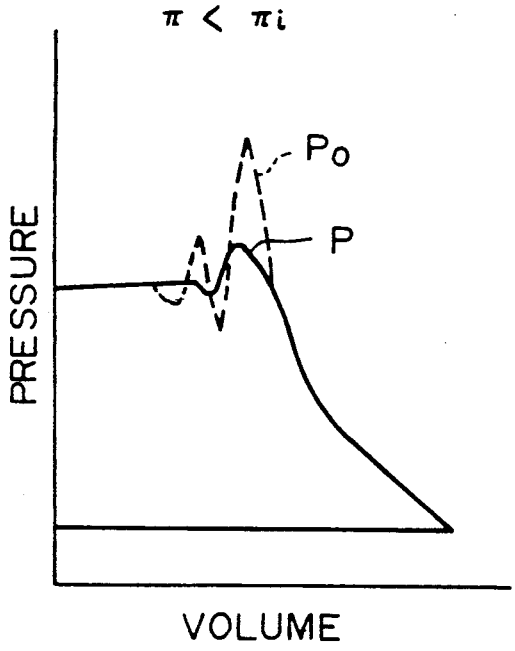
FIGS. 9(*a*) and 9(*b*) are graphs showing experimental results of a variation in the pressure at a discharge opening portion.
Figure 9B:
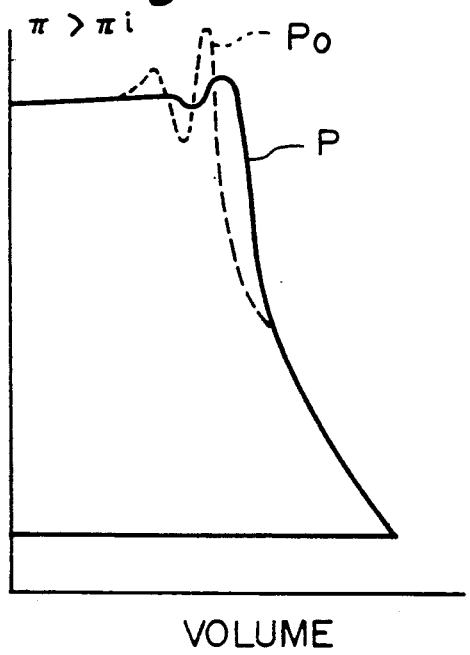

FIGS. 9(*a*) and 9(*b*) show actual variations in the pressure at the discharge opening when $\pi < \pi i$ and $\pi > \pi i$, respectively. In these figures, the conventional art wherein no notch portion is provided is illustrated with a broken line $P_0$, and the same in the invention wherein a notch portion is provided is illustrated with a continuous line P, respectively. It is clearly understood from these figures that the pressure variation of the present invention is smaller than that of the conventional art in any of the cases.

Figure 10:
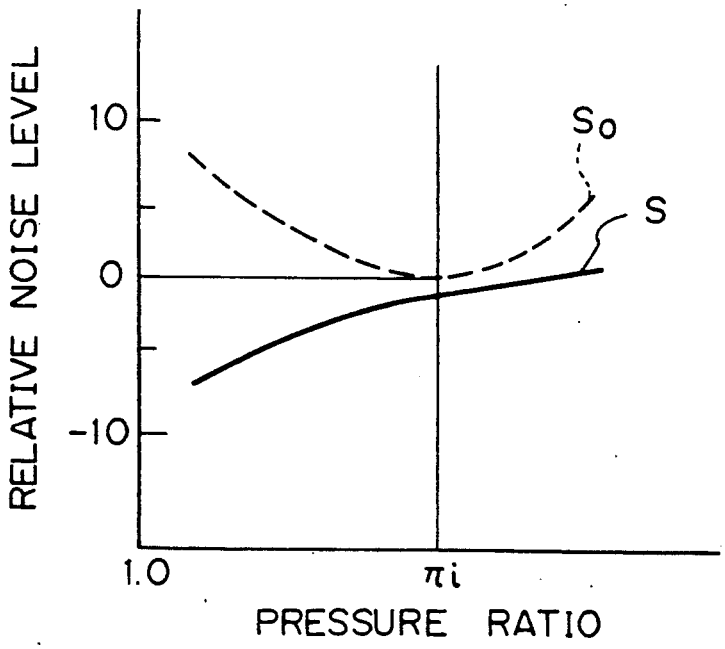
FIG. 10 is a graph of an experimental result of a relative noise level.

Referring to FIG. 10, a relative noise level in the present invention employing the notch portion is shown with a continuous line S, whereas the same in the conventional art without the notch portion is illustrated with a broken line $S_0$. In this figure, the minimum noise of the conventional art is set at level zero. From FIG. 10, it will also be understood that the relative noise level according to the invention is smaller than the same in the conventional art.

Figure 14:
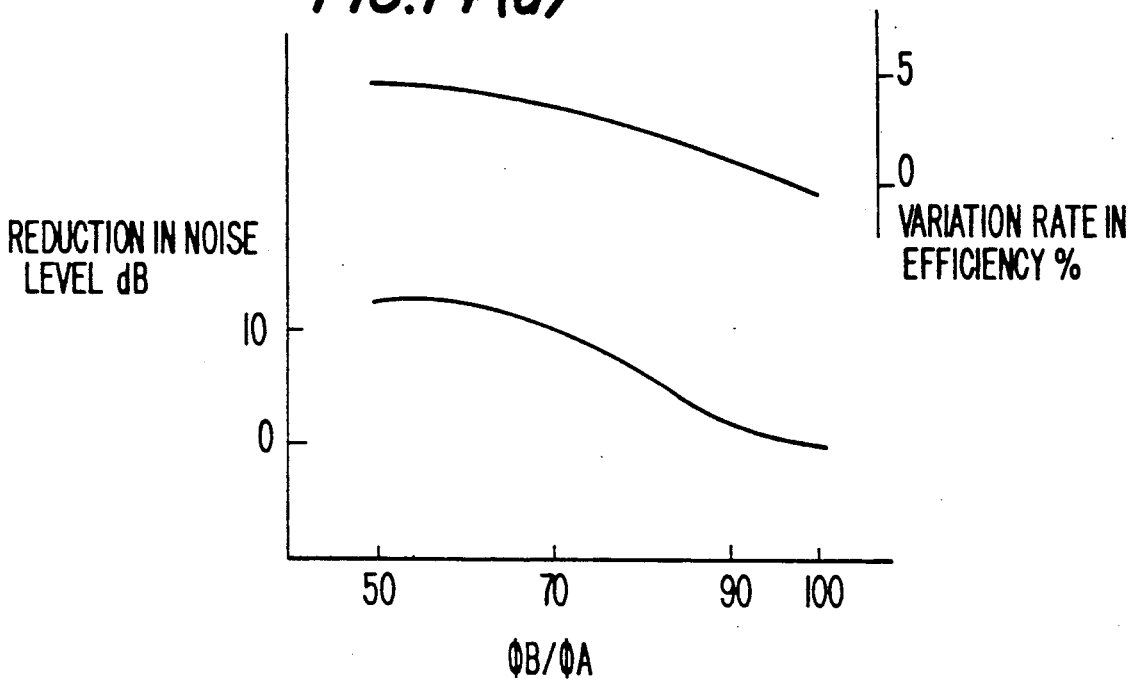
Figure 14:
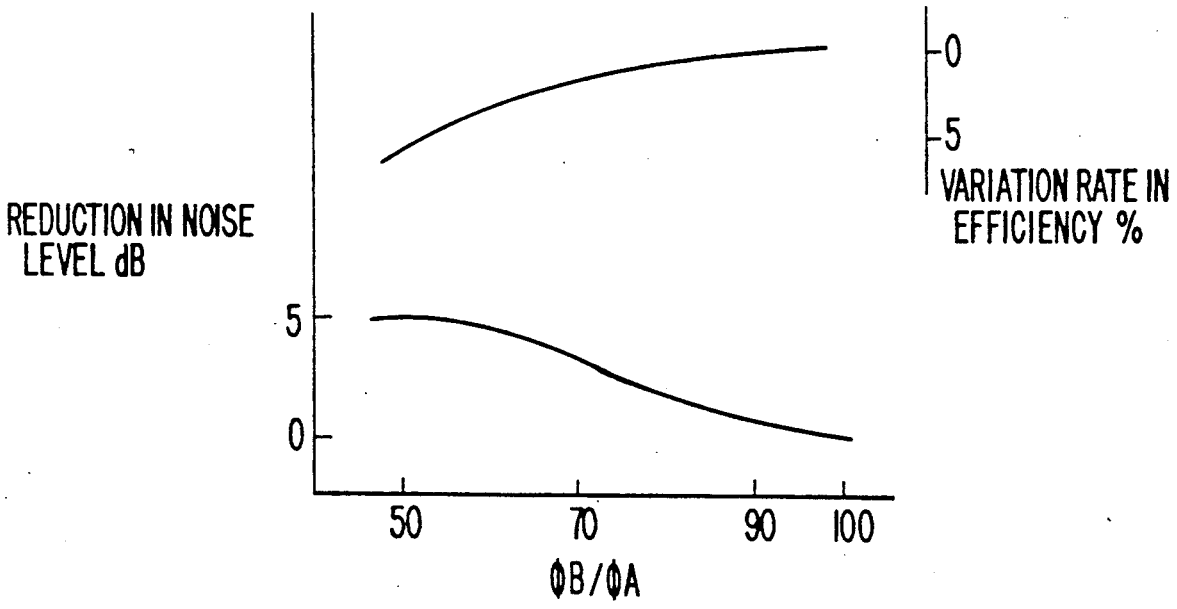

FIGS. 14(*a*) and 14(*b*) show a relationship between a reduction in the noise level and a variation rate of efficiency to a volume ratio of $\phi B/\phi A$ when $\pi < \pi i$ and $\pi > \pi i$, respectively. The volume ratio $\phi B/\phi A$ is a ratio of volume ratios $\phi B$ and $\phi A$ at points B and A in FIG. 8. From this test, it was confirmed that a reduction in a noise level is appreciably reduced while any lowering of a variation rate of efficiency is very small when the volume ratio $\phi B/\phi A$ is within a range 70%–90%.

Figure 11A:
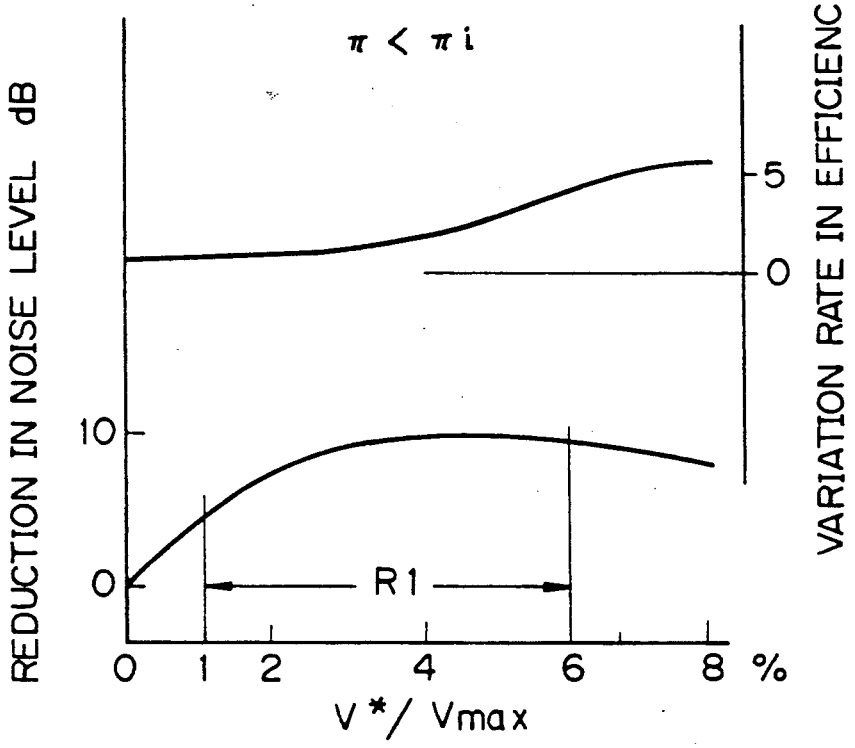
FIGS. 11(*a*), 11(*b*), 12(*a*), 12(*b*), 13(*a*), 13(*b*), 14(*a*) and 14(*b*) are characteristic graphs of the noise level reduction and the variation rate of efficiency, respectively, each showing results of the first, second, third and fourth experiments of a screw compressor according to the present invention.
Figure 11B:
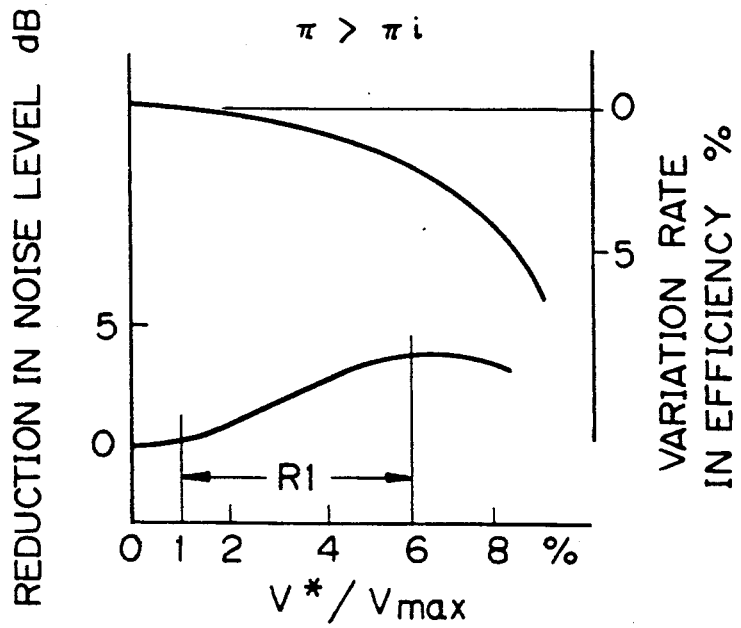

FIGS. 11(*a*) and 11(*b*) show relationships between a reduction in the noise level, a variation rate of efficiency and a ratio of the volume of the notch portion to the suction volume of one groove ($V^*/V_{max}$) when $\pi < \pi i$ and $\pi > \pi i$, respectively. In any case, it is recognized that the value of $V/V_{max}$ within 1%–6%, i.e. range R1, is the most effective for practical use.

Figure 12A:
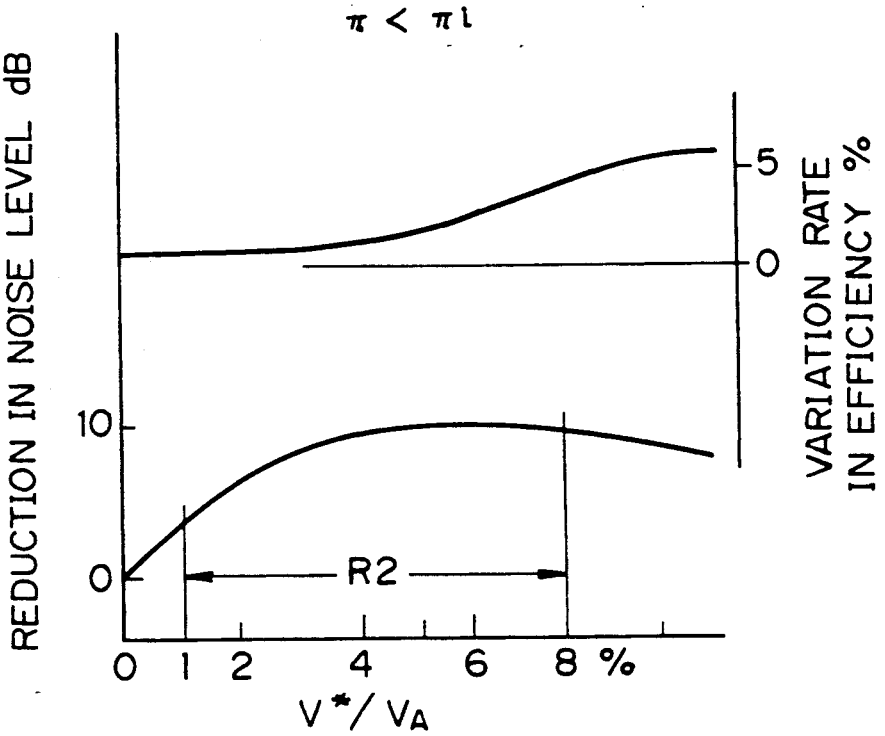
Figure 12B:
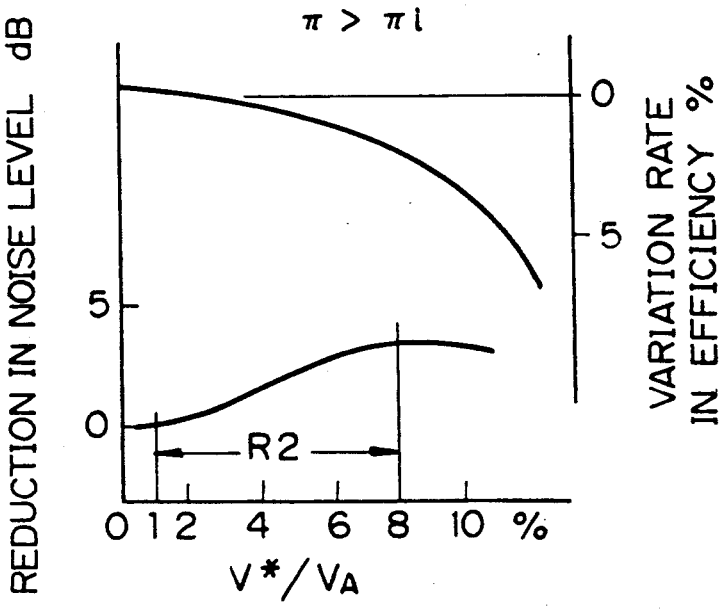

FIG. 12 shows experimental results of another test of the embodiment of the invention. In this test, it is confirmed that the value of a ratio (V*/VA) of the volume of the notch portion to the volume of the one groove at the fixed point A (FIG. 8), that is, the volume when the gas starts to be discharged from the one groove provided that the notch portion is not formed, within about 1%–8%, i.e. range R2, is the most effective for practical use in view of both a reduction in the noise level and a variation in the rate of efficiency.

Figure 13A:
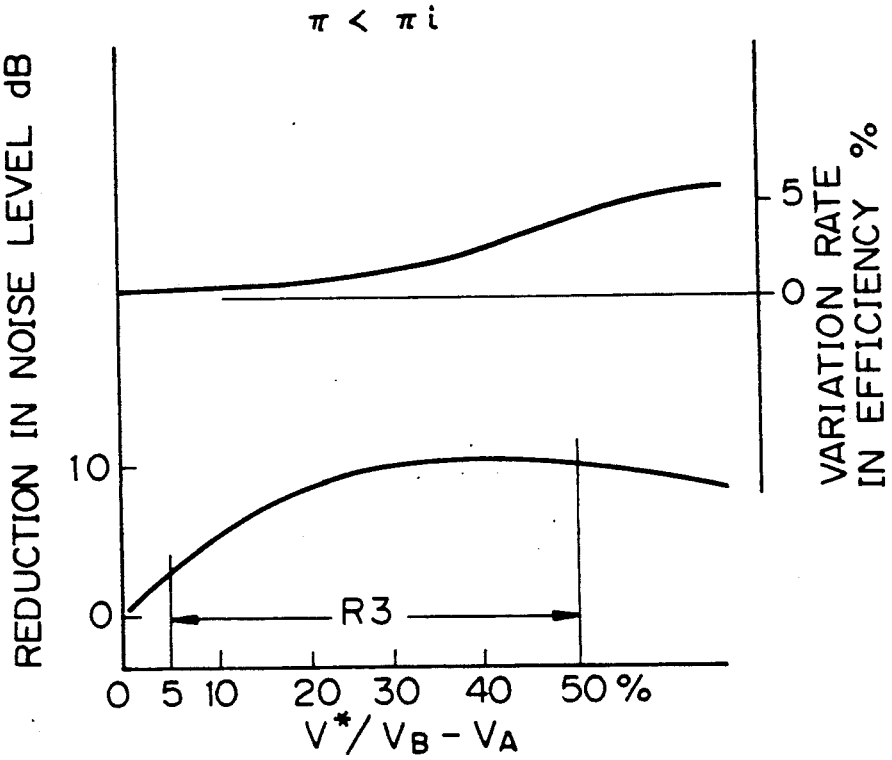
Figure 13B:
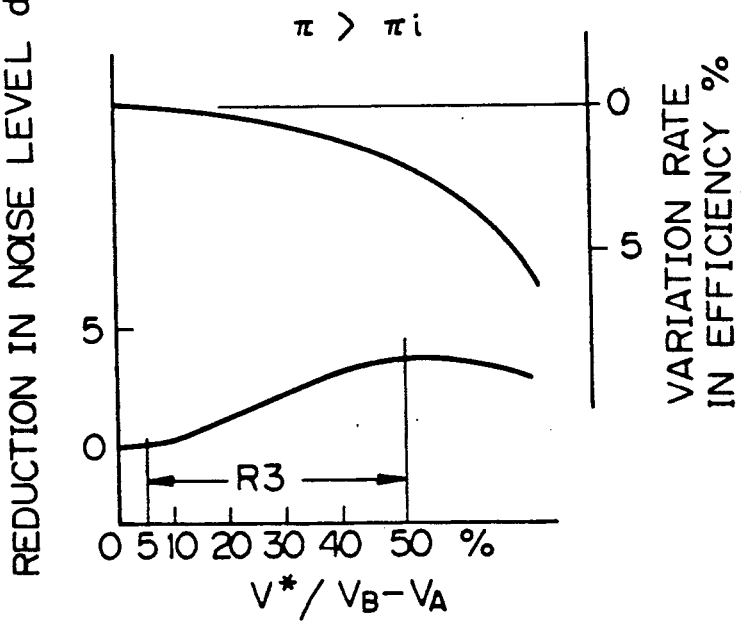

FIG. 13 illustrates experimental results of a still further test of the embodiment according to the invention. In this test, it is confirmed that the value of a ratio [V*/(VB−VA)] of the volume of the notch portion to a difference between the volumes at the fixed points A and B, that is, the decreasing amount of the volume of the one groove between the position where the gas starts to gradually be discharged through the notch portion and the position where the gas starts to be discharged without passing first through the notch portion of within about 5%–50%, i.e. range R3, is the most effective for practical use in view of both a reduction in the noise level and a variation in the rate of efficiency.

According to the present invention, the flow rate of the gas at the discharge opening portion is reduced by the notch portion which is simple and is readily formed, whereby the variation range of the pressure (the amplitude of pulsation of the pressure) is decreased and, therefore, the noise level is lowered. Further, a loss of pressure resulting from the rapid flow of the gas is restricted to thereby widen the preferable range of performance of the compressor.

What is claimed is:

1. A screw compressor for compressing gas, said compressor comprising:

a casing having a first end portion defining a suction opening therethrough and a second end portion defining a discharge opening therethrough, said casing also defining a generally tapered notch therein open to said discharge opening;

rotors rotatably supported within said casing, said rotors capable of forming at least one seal with said casing at seal lines defined between said rotors and said casing, and said rotors together defining at least one groove therein with said casing, rotation of said rotors successively increasing and decreasing the volume of said at least one groove to effect a suction intake of gas through the suction opening of the casing and a compression of the suctioned gas within said casing, rotation of said rotors effecting an initial discharge of the compressed gas from one said groove through said discharge opening via said generally tapered notch beginning at a first predetermined point in the rotation of said rotors at which said seal lines become disposed directly over at least a part of said notch, and the rotation of said rotors subsequently effecting a complete discharge of the compressed gas from said one groove through said discharge opening beginning at a second predetermined point in the rotation of said rotors at which said seal lines are no longer disposed directly over any part of said notch so that compressed gas flowing to said discharge opening from said one groove does not flow through said notch, and a volume ratio $\phi B/\phi A$ of the compressor being within a range of 70% to 90%, wherein $\phi B$ corresponds to $V_{max}/VB$, $\phi A$ corresponds to $V_{max}/VA$, $V_{max}$ is the maximum volume of said one groove during rotation of said rotors, VB is the volume of said one groove at said first predetermined point in the rotation of said rotors, and VA is the volume of said one groove at said second predetermined point in the rotation of said rotors.

2. The screw compressor as claimed in claim 1, wherein said tapered notch terminates along a forward edge defined by said casing at said discharge opening, and said forward edge extends parallel to said seal lines.

3. The screw compressor as claimed in claim 1, wherein the volume of said notch is within a range of about 1% to 6% of $V_{max}$.

4. The screw compressor of any one of claims 1–3, wherein the volume of said notch is within the range of about 1% to 8% of VA.

5. The screw compressor as claimed in claim 1, wherein the volume of said notch is within the range of about 5% to 50% of the value (VB-VA).

6. The screw compressor as claimed in claim 2, wherein the volume of said notch is within the range of about 5% to 50% of the value (VB-VA).

7. The screw compressor as claimed in claim 3, wherein the volume of said notch is within the range of about 5% to 50% of the value (VB-VA).

8. The screw compressor as claimed in claim 4, wherein the volume of said notch is within the range of about 5% to 50% of the value (VB-VA).

* * * * *